US006318383B1

(12) United States Patent
Wood

(10) Patent No.: US 6,318,383 B1
(45) Date of Patent: Nov. 20, 2001

(54) CLEANING AND SERVICING LAWN SPRINKLER HEADS

(76) Inventor: Charles L. Wood, 1425 Eastwind Cir., Westlake Village, CA (US) 91361

( * ) Notice: Subject to any disclaimer, the term of this patent is extended or adjusted under 35 U.S.C. 154(b) by 0 days.

(21) Appl. No.: 09/365,053

(22) Filed: Jul. 30, 1999

(51) Int. Cl.[7] ..... B08B 9/02; B08B 9/093

(52) U.S. Cl. ..... 134/22.1; 134/42; 134/22.18; 239/104; 239/106

(58) Field of Search ..... 134/22.1, 22.11, 134/22.12, 22.18, 24, 42; 239/104, 106

(56) References Cited

U.S. PATENT DOCUMENTS 2,605,091 * 7/1952 Socke ..... 432/11
2,720,420 * 10/1955 Seifferle ..... 239/104
3,385,735 * 5/1968 Brabrand et al. ..... 134/28
3,851,352 * 12/1974 Hibberd et al. ..... 134/166 C
4,995,915 * 2/1991 Sewell et al. ..... 134/22.12
5,376,181 * 12/1994 Reidick ..... 134/22.18
5,803,983 * 9/1998 Simandl et al. ..... 134/22.12
5,875,969 * 3/1999 Grundy ..... 239/113
6,045,059 * 4/2000 Weller ..... 239/203

* cited by examiner

*Primary Examiner*—Randy Gulakowski
*Assistant Examiner*—Saeed Chaudhry
(74) *Attorney, Agent, or Firm*—Blakely, Sokoloff, Taylor & Zafman LLP

(57) ABSTRACT

Disclosed is a method for servicing a lawn sprinkler head removed from a sprinkler system. Included within a servicing kit is a controller that may be used to regulate the flow of water through the sprinkler head remotely from the sprinkler system, a plug to secure the hole in the sprinkler system from where the sprinkler head was removed, a spacer that may be used to retain the nozzle of the sprinkler head in the deployed position, and a cleaning tool that may be used to dislodge debris from the nozzle water exit perforations. Other features are disclosed.

6 Claims, 2 Drawing Sheets

FIG. 1
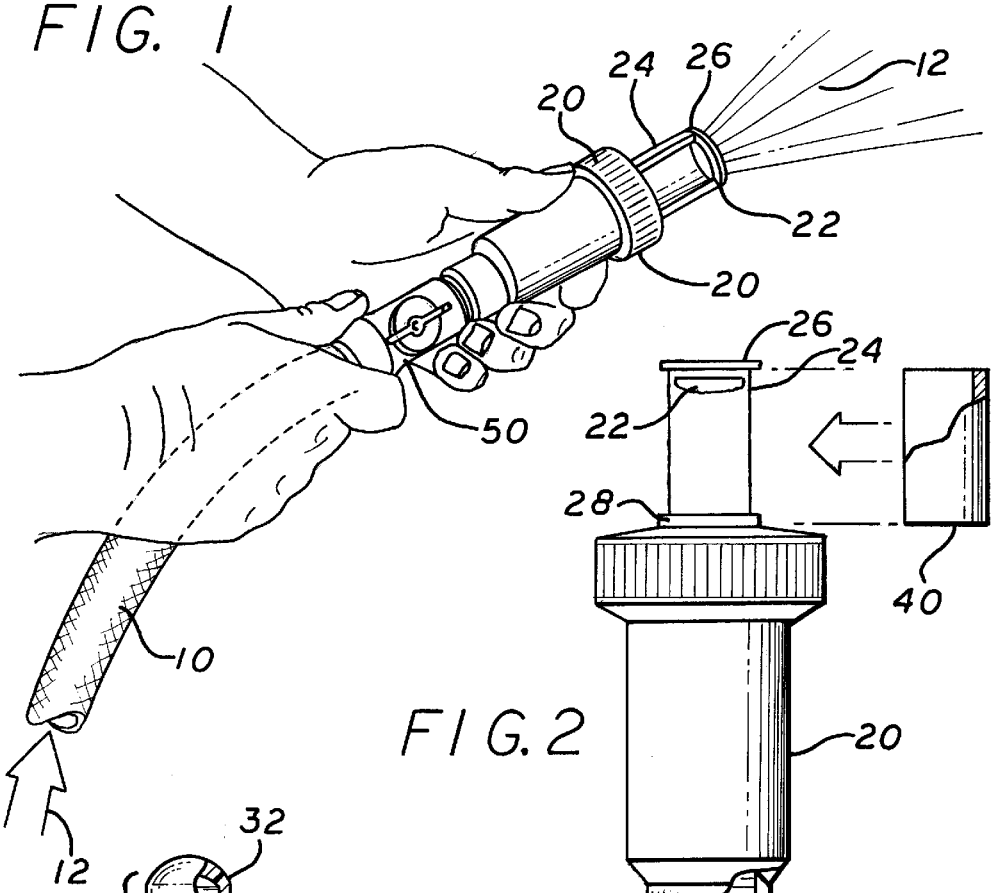
FIG. 2
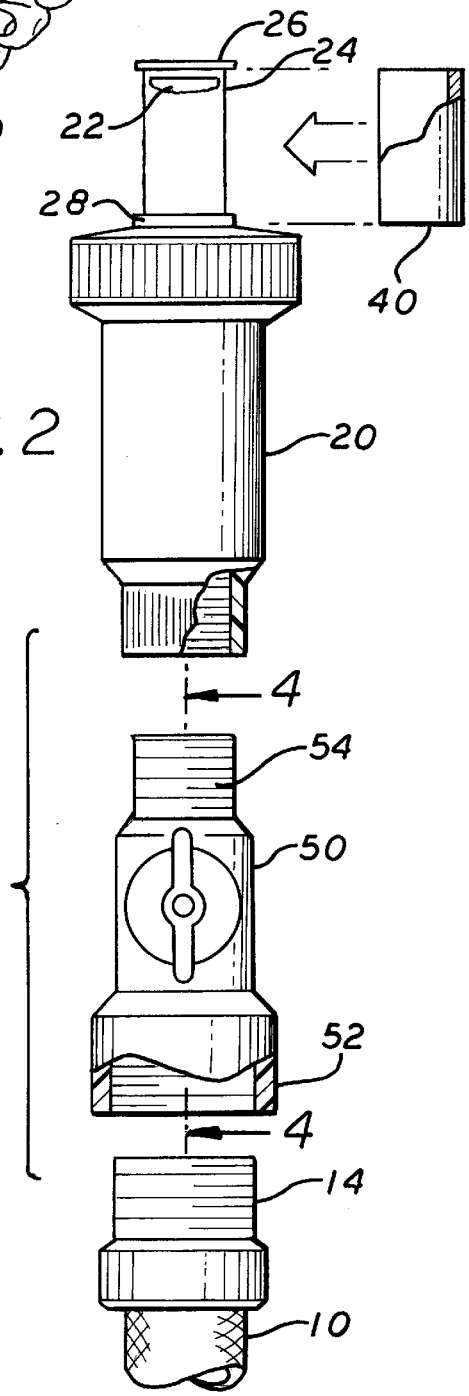
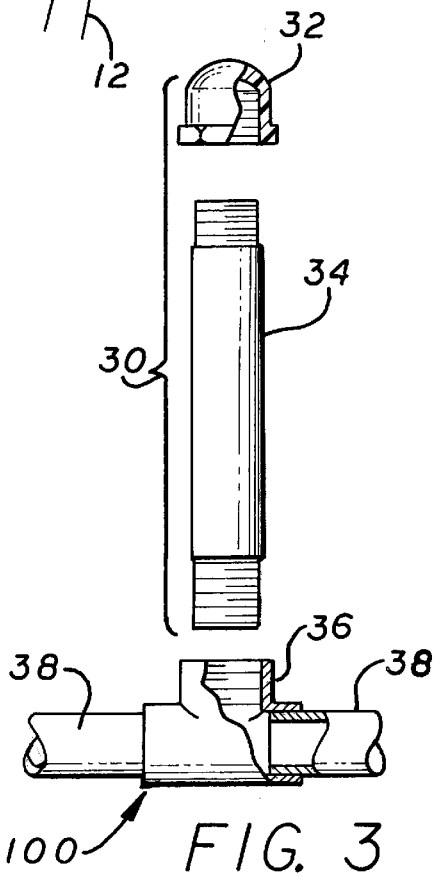
FIG. 3

CLEANING AND SERVICING LAWN SPRINKLER HEADS

BACKGROUND OF THE INVENTION

1. Field of the Invention

The present invention relates generally to servicing lawn sprinkler heads. More specifically, a coupling piece permits remote servicing of lawn sprinkler heads with a conventional garden hose.

2. Background Information

Lawn sprinkler systems for watering lawns include a system of pipes to which lawn sprinkler heads are attached. Lawn sprinkler heads conventionally have a pop-up perforated nozzle through which water issues from the system of pipes to sprinkle a lawn. When not used, a spring acts to maintain the nozzle of the head flush with the surface of the lawn. As pressurized water is fed through the system, the pressure of the water works against the spring to "pop" the nozzle of the head up and over the surface of the lawn.

Frequently, the perforations of sprinkler heads become obstructed with debris and restrict the flow of water to the lawn. Moreover, the debris frequently obstructs the vertical path of the nozzle so as to prevent the nozzle from deploying. An inoperative lawn sprinkler head, in turn, prevents the lawn sprinkler system from spraying the lawn in the localized area of the obstructed sprinkler head.

Historically, consumers have attempted to service an inoperative lawn sprinkler head as the head remains attached to the lawn sprinkler system. Two persons are required to fix an installed sprinkler head since one person must be stationed remotely at the water control device and the other stationed locally at the sprinkler head. Servicing an inoperative lawn sprinkler head as the head remains attached to the lawn sprinkler system is inconvenient since the obstruction of the sprinkler head generally is hard to reach and sometimes inaccessible. Moreover, coordination between two persons makes the conventional process an undesirably involved process.

Alternatively, consumers have attempted to service an inoperative lawn sprinkler head simply by removing and replacing the inoperative sprinkler head with a new sprinkler head. The problem with this solution is that it is expensive. Thus, there is a need for a convenient and less expensive method and apparatus that may be used to clean and service sprinkler heads remote from the sprinkler system.

SUMMARY OF THE INVENTION

Disclosed is a method and apparatus for servicing a lawn sprinkler head removed from a sprinkler system. Included within a servicing kit is a controller that may be used to regulate the flow of water through the sprinkler head remotely from the sprinkler system, a plug to secure the hole in the sprinkler system from where the sprinkler head was removed, a spacer that may be used to retain the nozzle of the sprinkler head in the deployed position, and a cleaning tool that may be used to dislodge debris from the nozzle water exit perforations. Other features are disclosed.

BRIEF DESCRIPTION OF THE DRAWINGS

FIG. 1 illustrates an operation of the invention;

FIG. 2 is an exploded assembly view of the invention;

FIG. 3 shows a plug being placed within a sprinkler system;

DETAILED DESCRIPTION OF THE INVENTION

Figure 4:
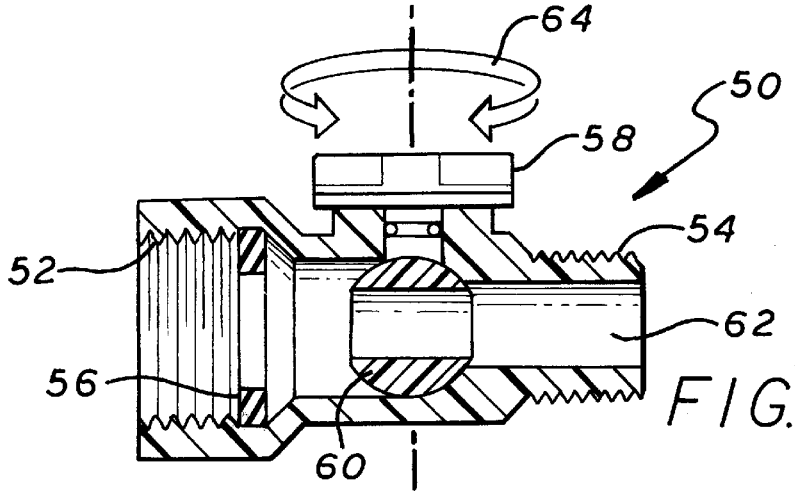
FIG. 4 is a side sectional view of controller 50 taken generally off of line 4—4 of FIG. 2.

FIG. 1 illustrates an operation of the invention. Sprinkler head 20 is prepared first by removing sprinkler head 20 from sprinkler system 100 (FIG. 3). Nozzle 24 is then raised against a pull down spring (not shown) of sprinkler head 20 and spacer 40 is placed about nozzle 24 so as to hold nozzle 24 up and away from the remainder of sprinkler head 20. With sprinkler head 20 prepared, pressurized water is brought from hose 10 to sprinkler head 20 so as to force water 12 through perforations 22 of nozzle 24. The volume and thus the pressure of water 12 is regulated by controller 50, which is coupled between hose 10 and sprinkler head 20. The flexibility of hose 10 permits the user to point sprinkler head 20 down into a container to catch water 12 as water 12 is released from nozzle 24.

FIG. 2 is an exploded assembly view of the invention. Hose 10 may be any flexible tube for conveying liquids under pressure. Preferably, hose 10 is a conventional garden hose coupled at a first end to the water system supplying a home and having threaded second end 14. The threads of threaded second end 14 may be conventional one half inch male pipe threads.

Water services enter a home through the water system of a city. The city water pressure is reduced at the inlet to each home to form home water pressure. The pressure of water 12 distributed through sprinkler system 100 of FIG. 3 varies over the length of the system, but is generally much lower than the home water pressure. The pull down springs of sprinkler heads are rated for pressure much lower than home water pressure and may be damaged by such high pressure. Thus it, is important to be able to control the pressure of water 12 after it leaves hose 10 and enters sprinkler head 20. Provided with the invention for this purpose is controller 50.

FIG. 4 is a side sectional view of controller 50 taken generally off of line 4—4 of FIG. 2. As shown, controller 50 includes female inlet 52, male outlet 54, washer 56, knob 58, and ball 60. Female inlet 52 preferably is formed of one half inch female pipe threads. This permits controller 50 to be coupled to threaded end 14 of a conventional garden hose, such as hose 10 shown in FIG. 2. Washer 56 works to seat threaded end 14 of hose 10 to minimize leaks between the coupling.

Male outlet 54 preferably is formed of one half inch male pipe threads since water is distributed about most homes through pipes having threaded ends of one half inch pipe threads. As shown in FIG. 4, male outlet 54 is in fluid communication with female inlet 52 through lumen 62. Lumen 62 is an inner open space or cavity through the tube shape of controller 50 that permits water 12 to flow therethrough. To be able to control the pressure of water 12 after it leaves hose 10 and passes through lumen 62, ball 60 is placed in the path of the water flow and coupled to knob 58. Knob 58 and ball 60 make up the operative portions of a conventional controllable ball valve. With knob 58 orientated in the direction shown in FIG. 4, water 12 is permitted to flow through controller 50. By turning knob 58 ninety degrees in one of the directions indicated by arrow 64, ball 60 blocks the flow of water 14 through lumen 62. By adjusting knob 58 to an angle between zero and ninety degrees, the flow, and thus the pressure of water 14 is variably controlled after it leaves hose 10 and enters sprinkler head 20. In this way, water pressure greater than that used within sprinkler system 100 may be applied to nozzle 24 to unclog debris such as grass and dirt from sprinkler head 20.

Figure 5:
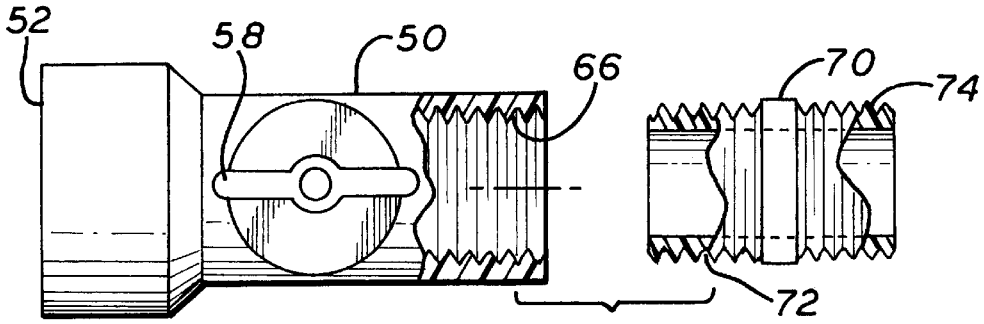
FIG. 5 shows an alternate embodiment of controller 50.

FIG. 5 shows an alternate embodiment of controller 50. In this alternative embodiment, controller 50 includes female inlet 52 and female outlet 66 as shown in FIG. 5. Female outlet 66 may be any thread size. Where controller 50 includes female outlet 66, kit 200 is provided with water pressure coupler 70. At end 72, water pressure coupler 70 is provided with a male thread that is the complement to female outlet 66. At end 74, water pressure coupler 70 is provided with male end 74 which preferably is a one half inch male pipe thread.

Returning to FIG. 2, sprinkler head 20 is shown with a conventional female water inlet end. Controller 50 is coupled to this female end of sprinkler head 20 at male outlet 54 of controller 50. Where water pressure coupler 70 is fixed to controller 50, male end 74 of water pressure coupler 70 is coupled to this female end of sprinkler head 20.

Spacer 24 shown in FIG. 2 is a semi-circle that is extended vertically into a hollow tube. Spacer 40 provides the owner or operator of sprinkler system 100 with the continuous ability to evaluate and repair nozzle 24. Normally, repair of sprinkler head 20 requires a continuous struggle against the spring that retains the top of nozzle 24 flush with the surface of the lawn. Spacer 40 eliminates this struggle by providing a mechanical wedge between lip 26 of nozzle 24 and rim 28 of sprinkler head 20.

The semi-circular profile of spacer 24 provides an open gap along the length of spacer 40. This gap is pressed against the sides of nozzle 24 until the gap of spacer 24 expands and slides around the side wall of nozzle 24. The spring attached to nozzle 24 pulls down on nozzle 24 so that spacer 24 is held in place between lip 26 and rim 28. This holds nozzle 24 in a fixed extended status, where cleaning tool 202 (FIG. 6) may be used to remove grass and dirt from perforation 22 of nozzle 24. This also allows a user to apply lubricant to the cylindrical surface of nozzle 24 before testing the functionality of nozzle 24 by raising and lowering nozzle 24. Preferably, spacer 24 is made of plastic or hard rubber.

There are several ways in which an owner or operator of sprinkler system 100 may deploy or raise nozzle 24 to position spacer 40 about nozzle 24. Preferably, nozzle 24 is raised by one hand as sprinkler head 20 is held in place by a clamping device, such as sprinkler system 100. Alternatively, water 12 is forced from hose 10 through sprinkler head 20 with sufficient force to overcome the pull down spring and raise nozzle 24. As water 12 is directed into a bucket, nozzle 24 is raised to be in a position to accept spacer 40.

Even with sprinkler head 20 removed from sprinkler system 100, it may still be important to be able to operate sprinkler system 100. FIG. 3 illustrates the use of plug 30 within sprinkler system 100. Plug 30 includes plug riser 34 and plug cap 32. Plug riser 34 is an elongated tube preferably threaded at each end with one half inch male pipe threads. One end reaches down to fit within a female thread of T-Joint 36 coupled to pipe 38 of sprinkler system 100. On the other end may be plug cap 32. When installed, plug 30 prevents dirt from getting into the open underground sprinkler pipe 38 and works to prevent water from flowing out of T-Joint 36 should sprinkler system 100 be operated while the service work on sprinkler head 20 is being completed. Alternatively, plug 30 may be comprised of a plug riser having one end threaded and the other end permanently sealed.

Figure 6:
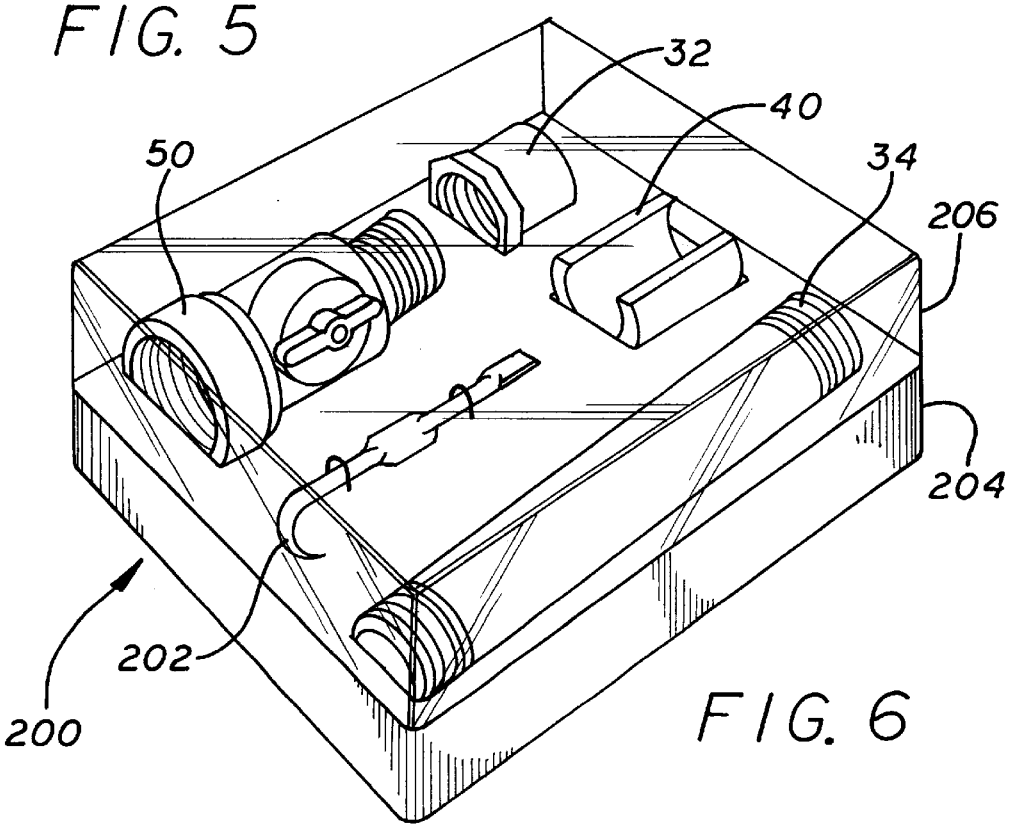
FIG. 6 illustrates kit 200 of the invention.

FIG. 6 illustrates kit 200 of the invention. Preferably, kit 200 includes controller 50, plug cap 32, spacer 40, plug riser 34, and cleaning tool 202 disposed within the interior of kit 200. Cleaning tool 202 preferably is a plastic "needle-like" tool that is used to pick and remove dirt and grass from clogged and inoperative sprinkler heads. Kit 200 may also include water pressure coupler 70 and a container of lubricant. The lubricant may be any substance, such as grease or oil, that reduces friction when applied as a surface coating to moving parts. Preferably, the lubricant is silicon base so as to hold up in the face of applied water. Base 204 preferably is a molded plastic base having indentations that secure and present the pieces of kit 200 in place. Lid 206 preferably is made of a clear plastic through which prospective purchasers may view presented pieces of kit 200.

In an alternative embodiment, kit 200 includes cleaning tool 202, spacer 40, plug 30, a container of lubricant, water pressure coupler 70, and controller 50. Each item is bubble packed into a bubble-packed kit.

In operation, lawn sprinkler head 20 of sprinkler system 100 may be serviced by the following actions. Lawn sprinkler head 20 is first removed from a connection such as T-Joint 36 in sprinkler system 100. Plug 30 is inserted into T-Joint 36 in sprinkler system 100. Sprinkler head 20 is attached to controller 50 and controller 50 is attached to hose 10. Nozzle 24 is then displaced from its resting position and spacer 40 is inserted about nozzle 24. Displacing nozzle 24 from a rest position may include cleaning debris away from nozzle 24 with cleaning tool 202 and lubricating the nozzle with lubricant. Water is then forced from hose 10 through nozzle 24.

By applying the invention, a sprinkler system owner will be able to service an obstructed sprinkler head at any faucet the owner chooses, whether on the side of the home, in the home, or in the garage. Testing remotely from sprinkler system 100 allows the user to check sprinkler head 20 without being sprayed when water 12 is forced through nozzle 24.

Local control over the servicing and maintenance of an inoperative lawn sprinkler head eliminates the need for two or more persons in fixing the sprinkler head. Since only one person is required to operate the invention, the prior technique requirement for communication and coordination between two persons is eliminated.

While certain exemplary embodiments have been described and shown in the accompanying drawings, it is to be understood that such embodiments are merely illustrative of and not restrictive on the broad invention. The scope of each claim term is not limited to the specific constructions and arrangements shown and described, since various other modifications may occur to those ordinarily skilled in the art.

What is claimed is:

1. A method for cleaning and servicing a lawn sprinkler head of a sprinkler system, the lawn sprinkler head having a nozzle, the method comprising:

removing the lawn sprinkler head from a connection in the sprinkler system;

inserting a plug into the connection in the sprinkler system;

attaching the lawn sprinkler head to a controller;

attaching the controller to a hose;

displacing the nozzle from a rest position;

inserting a spacer about the nozzle; and forcing water from the hose through the nozzle.

2. The method of claim 1, wherein displacing the nozzle from a rest position includes cleaning debris away from the nozzle with a cleaning tool and lubricating the nozzle with lubricant.

3. The method of claim 1, the sprinkler system having a water pressure, wherein displacing the nozzle from a rest position includes forcing water from the hose through the nozzle at a pressure that is greater than the water pressure within the sprinkler system.

4. The method of claim 3, wherein forcing water from the hose through the nozzle includes pointing the lawn sprinkler head down into a container to catch the water.

5. The method of claim 4, the controller including a female inlet, a male outlet in fluid communication with the female inlet through a lumen, a knob, and a ball coupled to the knob and disposed within the lumen, wherein forcing water from the hose through the nozzle includes rotating the knob to a second angle orientation that is less than ninety degrees from a first angle orientation of the knob.

6. The method of claim 1, wherein attaching the lawn sprinkler head to a controller includes attaching a water pressure coupler between the lawn sprinkler head and the coupler.

* * * * *

UNITED STATES PATENT AND TRADEMARK OFFICE

CERTIFICATE OF CORRECTION

PATENT NO. : 6,318,383 B1
DATED : November 20, 2001
INVENTOR(S) : Wood

It is certified that error appears in the above-identified patent and that said Letters Patent is hereby corrected as shown below:

Title page,
Item [57], ABSTRACT,
Line 1, after "method", please insert -- and apparatus --.

Signed and Sealed this

Sixteenth Day of November, 2004

JON W. DUDAS
*Director of the United States Patent and Trademark Office*